US010952481B2

(12) United States Patent
Williams et al.

(10) Patent No.: US 10,952,481 B2
(45) Date of Patent: Mar. 23, 2021

(54) HAIR EXTENSION

(71) Applicants: Quintina Williams, West Bloomfield, MI (US); Brittni S. B. Abiolu, Westland, MI (US)

(72) Inventors: Quintina Williams, West Bloomfield, MI (US); Brittni S. B. Abiolu, Westland, MI (US)

( * ) Notice: Subject to any disclaimer, the term of this patent is extended or adjusted under 35 U.S.C. 154(b) by 820 days.

(21) Appl. No.: 15/157,592

(22) Filed: May 18, 2016

(65) Prior Publication Data

US 2017/0135432 A1 May 18, 2017

Related U.S. Application Data

(63) Continuation-in-part of application No. 14/943,698, filed on Nov. 17, 2015, now Pat. No. 10,085,505.

(60) Provisional application No. 62/081,055, filed on Nov. 18, 2014.

(51) Int. Cl.
*A41G 5/00* (2006.01)

(52) U.S. Cl.
CPC ..... *A41G 5/0073* (2013.01)

(58) Field of Classification Search
CPC ..... A41G 5/00; A41G 5/004; A41G 5/0046; A41G 5/0053; A41G 5/0073
USPC ..... 132/201, 53
See application file for complete search history.

(56) References Cited

U.S. PATENT DOCUMENTS 1,775,209 A * 9/1930 Oppenheim ..... A41G 5/004 132/105
2005/0115581 A1* 6/2005 Choi ..... A41G 5/004 132/53
2008/0190442 A1* 8/2008 Kwak ..... A41G 5/0026 132/273
2013/0233330 A1* 9/2013 Nagatomo ..... A45D 8/22 132/53
2013/0263871 A1* 10/2013 Glass ..... A41G 5/0073 132/54
2016/0050996 A1* 2/2016 Kwon ..... A45D 8/30 132/201

* cited by examiner

*Primary Examiner* — Rachel R Steitz
*Assistant Examiner* — Brianne E Kalach
(74) *Attorney, Agent, or Firm* — The Weintraub Group, P.L.C.

(57) ABSTRACT

A hair extension removably secured to a hair extension attachment apparatus, including a at least one hook for attaching the hair extension. The hair extension includes a band having a front surface and a back surface. A plurality of hair strands are attached to the back surface of the band and extend downwardly therefrom. The hair extension further includes an elongated retaining member attached to the front surface of the band at at least one of intervals. The at least one interval forms a pocket between the band and the retaining member, which facilitates removably mounting the hair extension onto the at least one hook of the hair extension attachment apparatus by inserting the hook into the associated pocket.

13 Claims, 8 Drawing Sheets

HAIR EXTENSION

CROSS REFERENCE TO RELATED APPLICATION

This application is a continuation-in-part application that claims the benefit of co-pending U.S. Non-Provisional patent application Ser. No. 14/943,698, filed Nov. 17, 2015, for "Hair Extension Attachment Apparatus," which claims priority to U.S. Provisional Patent Application Ser. No. 62/081,055, filed Nov. 18, 2014, the entire disclosure of which is hereby incorporated by reference in its entirety including the drawing.

BACKGROUND OF THE INVENTION

1. Field of the Invention

The present invention relates to hair extensions. More specifically, the invention relates to hair extensions that are interchangeable and removably secured to the user's hair.

2. Description of Related Art

Hair extensions are often used in order to make a person's hair appear thicker and fuller. However, hair extensions are often affixed to the user's hair using hair glue, which can damage the user's hair and can make it difficult to remove the extensions. Alternatively, hair extensions having a comb-like attachment are often used to eliminate the disadvantages of using hair glue. However, the use of such devices involves the use of hair extensions that are permanently affixed to the comb. This limits the user to using only a single hair extension with one color, thickness, and length, in combination with the comb.

Further, the majority of hair extensions are merely small sections of hair and cover only a portion of one's head, thus requiring the user to insert several hair extension sections into one's hair in order to obtain a desired style, length, thickness, color, and effect. This method of installing hair extensions can be a time consuming and tedious process, often requiring another person to assist the user in order to properly and securely affix the hair extensions into one's hair. Thus, a new and improved combined hair extension attachment apparatus and hair extension that is interchangeable and removably secured to the user's hair is desired.

It is to this to which the present invention is directed

SUMMARY OF THE INVENTION

In view of the foregoing disadvantages inherent in the known types of hair extensions now present in the prior art, the present invention provides a new hair extension assembly for providing convenience to the user when placing hair extensions into one's hair.

It is therefore an object of the present invention to provide a new and improved hair extension assembly comprising a hair extension and a hair extension attachment apparatus that has all of the advantages of the prior art and none of the disadvantages.

It is another object of the present invention to provide a hair extension attachment apparatus that is flexible in order to conform to the shape of a user's head.

Another object of the present invention is to provide a hair extension attachment apparatus that remains hidden and unexposed when applied to a user's head.

Another object of the present invention is to provide a hair extension attachment apparatus having one or more clamps for attachment to the hair of the user.

Another object of the present invention is to provide a hair extension attachment apparatus having one or more hooks in order to grasp and secure a hair extension therein.

Yet another object of the present invention is to provide a hair extension having means for attaching it to the hair extension attachment apparatus.

Other objects, features, and advantages of the present invention will become apparent from the following detailed description taken in conjunction with the accompanying drawing.

For a better understanding of the present invention, reference is made to the accompanying drawing and detailed description. In the drawing, like reference characters refer to like parts through the several views, in which:

BRIEF DESCRIPTIONS OF THE DRAWINGS

DETAILED DESCRIPTION OF THE INVENTION

Figure 1:
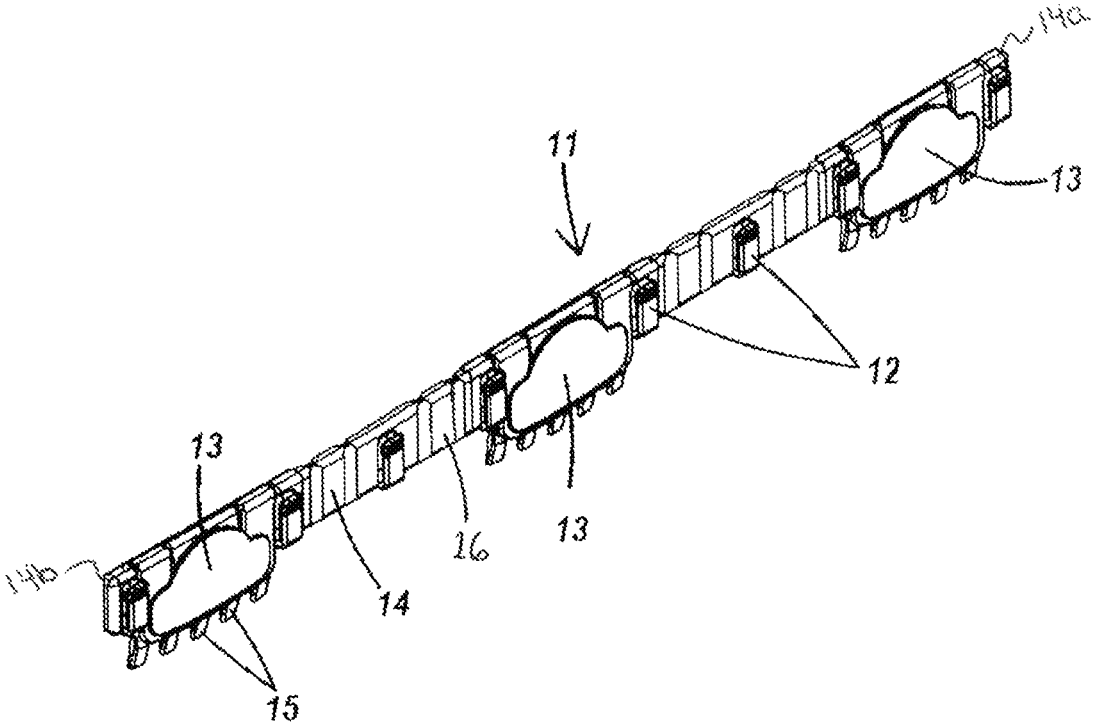
FIG. 1 is a front view of a hair extension attachment apparatus in accordance with the present invention in a closed configuration.
Figure 2:
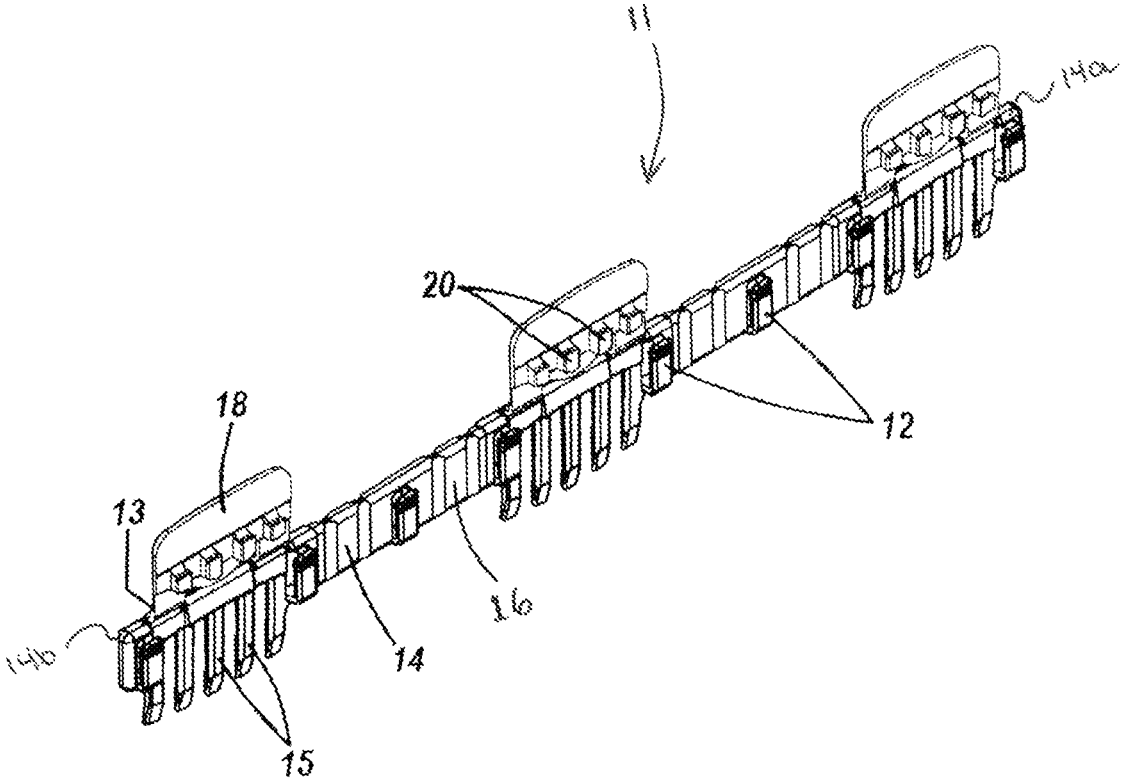
FIG. 2 is a front view of the hair extension attachment apparatus thereof in an open configuration.
Figure 3:
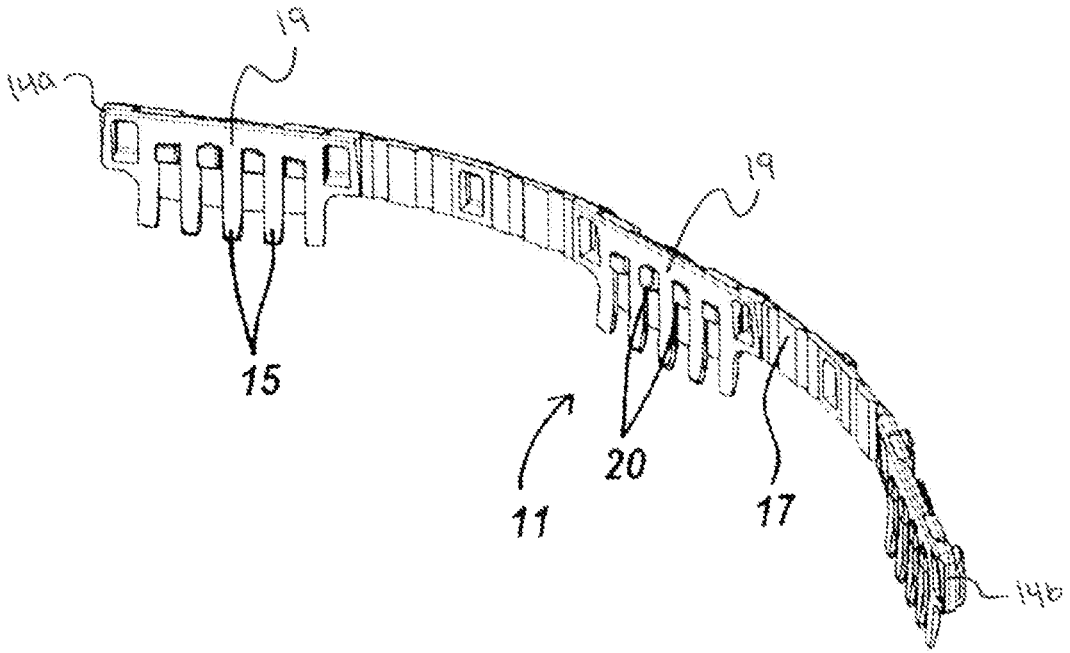
FIG. 3 is a back view of the hair extension attachment apparatus thereof.

Referring now to FIGS. 1-3, and as discussed in the co-pending application, there is provided a hair extension attachment apparatus 11 comprising: (a) an elongated strip 14 having a front surface 16, a back surface 17 and opposing ends 14*a*, 14*b*; (b) at least one clamp 13 disposed on the front surface 16 of the elongated strip 14 for removably securing the elongated strip 14 to the hair of the user; and (c) at least one hook 12 disposed on the front surface 17 of the elongated strip 14 for removably securing a hair extension 30 thereon, as discussed below.

The elongated strip 14 preferably comprises a substantially rectangular configuration and comprises a flexible material that can contour to the shape of the user's head. The back surface 17 is preferably smooth and flat so that it can comfortably rest against the user's head. The elongated strip 14 is disposed in a horizontal orientation in any of various positions on the user's head, such as on the front of the user's head or the back of the user's head.

Preferably, a plurality of clamps 13 are spaced at a fixed interval on the elongated strip 14. Each clamp 13 comprises a comb member 19 having a plurality of tines 15, wherein the tines 15 are linear in structure. Further, the tines 15 are arranged in a parallel orientation to one another and are spaced at a fixed interval. The spaces between the tines 15 receive a plurality of strands of hair therethrough such that the plurality of tines 15 become interlocked with the user's hair. Each clamp 13 further comprises a closure member 18, wherein the closure member 18 comprises a rectangular shape in a preferred embodiment. The closure member 18 is pivotally affixed to an upper end of the comb member 19 and is movable between an open configuration and a closed configuration. The closure member 18 is arranged in an open configuration so that hair can be inserted into the comb member 19, and then the closure member 18 is closed so as to secure the hair within the clamp 13.

An interior portion of the closure member 18 provides a plurality of teeth 20 that are arranged in a parallel and linear orientation in relation to one another such that the plurality of teeth 20 align with the spaces between the plurality of tines 15 and extend therethrough.

As shown in FIG. 3, when the closure member 18 is in a closed configuration, each tooth of the plurality of teeth 20 is secured in the spaces between the tines of the plurality of comb members 19. This helps to secure the hair within each clamp 13 and helps to retain each of the clamps 13 in the closed configuration until it is desired to open the clamps 13. Each clamp 13 moves between the closed configuration to the open configuration by applying manual pressure to the closure member 18 to disengage the teeth 20 from the plurality of tines 15. This way, the user can easily detach the hair extension attachment apparatus 11 when not in use.

Referring again to FIGS. 1 and 2, preferably, a plurality of hooks 12 are disposed at a fixed interval from one another and arranged in alternating fashion with the plurality of clamps 13. Each of the plurality of hooks 12 comprises an L-shaped configuration, wherein each hook 12 extends outwardly from the elongated strip 14 and comprises an upwardly extending portion that is substantially parallel to the front surface 16 of the elongated strip 14. Thus, the hook 12 provides a hollow channel 22 that can receive an elongated band 35 of a hair extension 30, as noted below. The hooks 12 are substantially rigid, yet provide a slight flexibility such that the hair extension 30 can be seated within the hollow channel 22 of each hook 12 and secured therein.

While the above disclosure of the hair extension attachment apparatus 11 was sufficiently disclosed in the co-pending application, the following description pertaining to the hair extension 30 reflects the improvement provided in this application. The improvement to the hair extension 30 discussed hereinbelow discloses improved means for facilitating the hair extension 30 attaching to the hair extension attachment apparatus 11 in order to provide a stronger connection between the two components.

Figure 4:
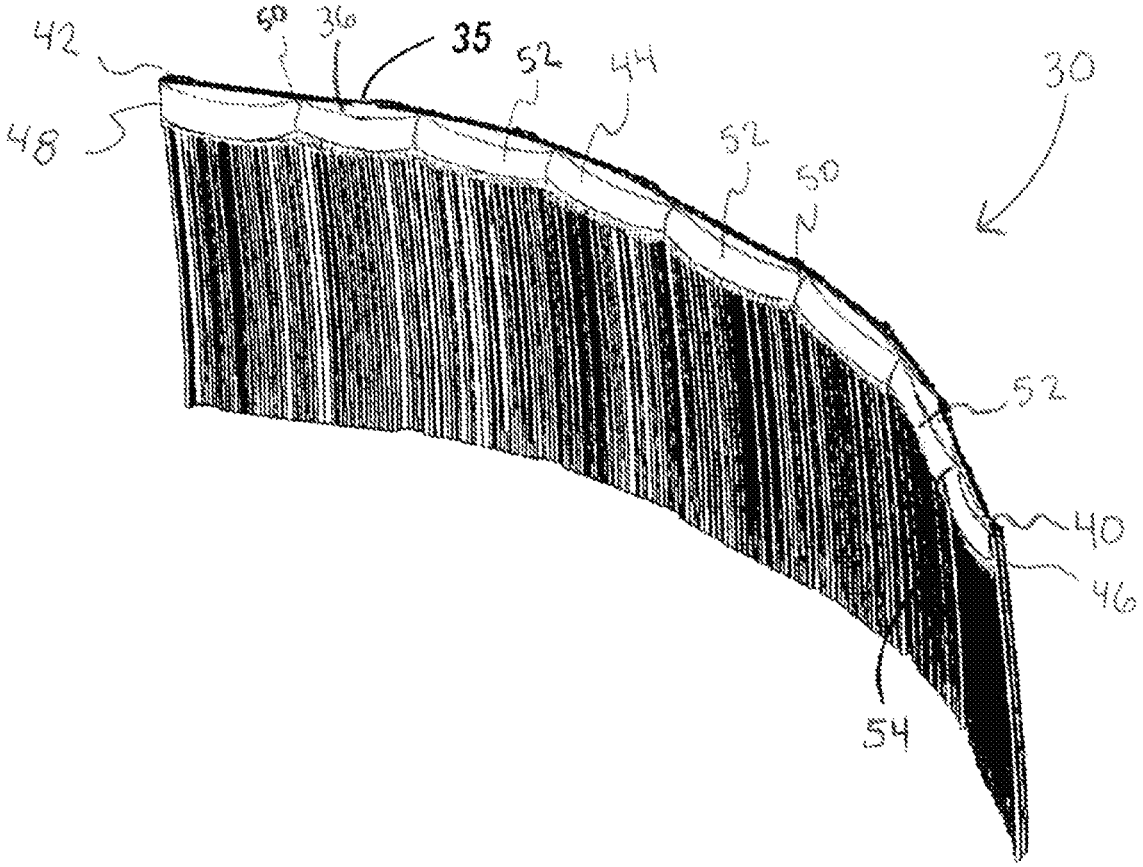
FIG. 4 is a front view of a hair extension in accordance with the present invention.
Figure 5:
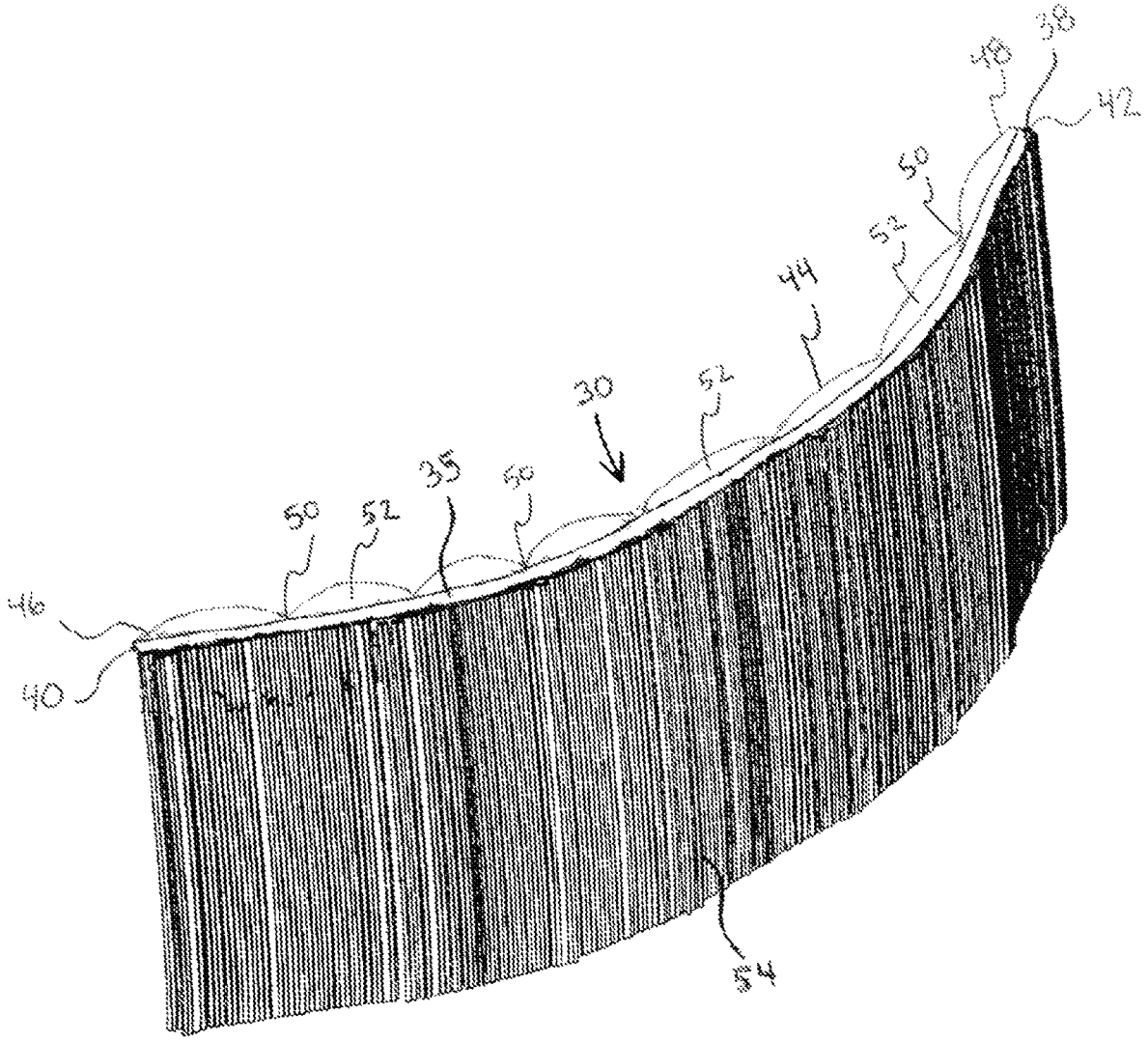
FIG. 5 is a back view of the hair extension thereof.

Referring now to FIGS. 4 and 5, the hair extension 30 comprises an elongated band 35, having a front surface 36, a back surface 38, and opposing ends 40, 42. The hair extension 30 further comprises an elongated retaining member 44 having similar dimensions to that of the band 35. Opposing ends 46, 48 of the retaining member 44 are attached to corresponding ends 40, 42 of the band 35, respectively, over the front surface 36 of the band 35. The retaining member 44 comprises any suitable material such as a fabric, plastic, rubber, and the like. Preferably, the retaining member 44 comprises the same material used in manufacturing the band 35. The retaining member 44 is further secured to the band 35 at at least one interval 50 along the length of the retaining member 44. Preferably, the retaining member 44 is secured to the band 35 at a plurality of intervals 50 along the entire length of the retaining member 44. The retaining member 44 is secured to the band 35 at the intervals 50 by any suitable means such as sewing, gluing, and the like. Each of the plurality of intervals 50 defines a pocket 52 formed between the band 35 and the retaining member 44. The location of each of the plurality of intervals 50 are determined based on the location of the corresponding hooks 12 such that each of a plurality of pockets 52 aligns with an associated hook 12.

The hair extension 30 further comprises a plurality of faux hair strands 54 attached by any suitable means, such as sewing, gluing, and the like, to the back surface 38 of the band 35 and extending downwardly, thus forming a unitary and planar structure having a substantially rectangular shape.

Figure 8:
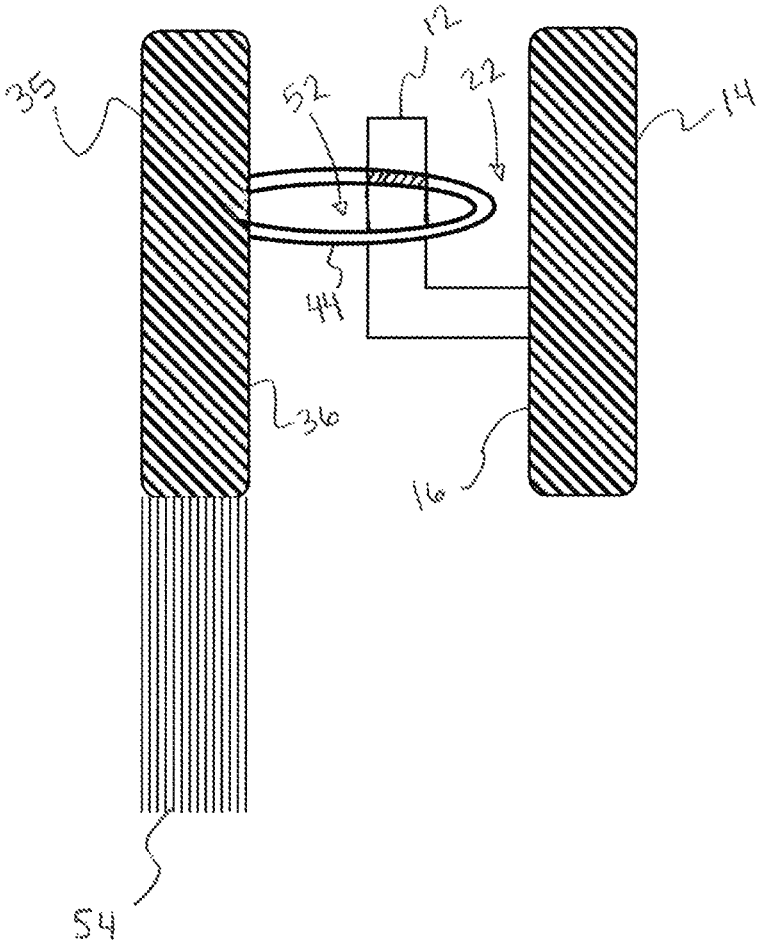
FIG. 8 is a cross-sectional view along line A-A of FIG. 6.

As shown in FIG. 8, to mount the hair extension 30 onto the hair extension attachment apparatus 11, the user places the front surface 36 of the band 35 over the front surface 16 of the elongated strip 14 such that each of the plurality of pockets 52 of the retaining member 44 is inserted into the hollow channel 22 of an associated hook 12. The hollow channel 22 is very narrow so that the band 35 of the hair extension 30 lies flush and snugly against the extension portion of each hook 12.

Figure 6:
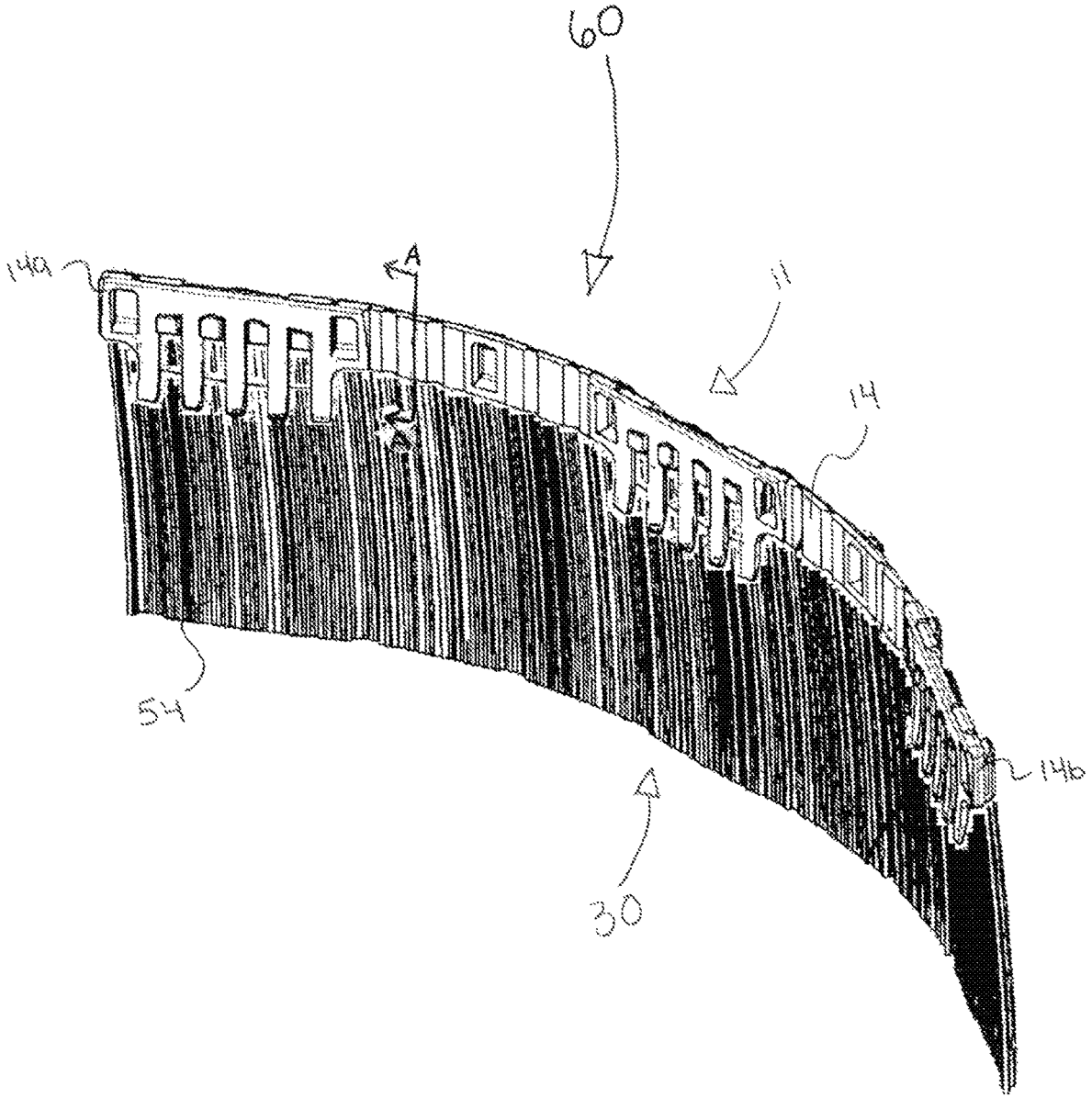
FIG. 6 is front view of a hair extension assembly with the hair extension attached to the hair extension attachment apparatus
Figure 7:
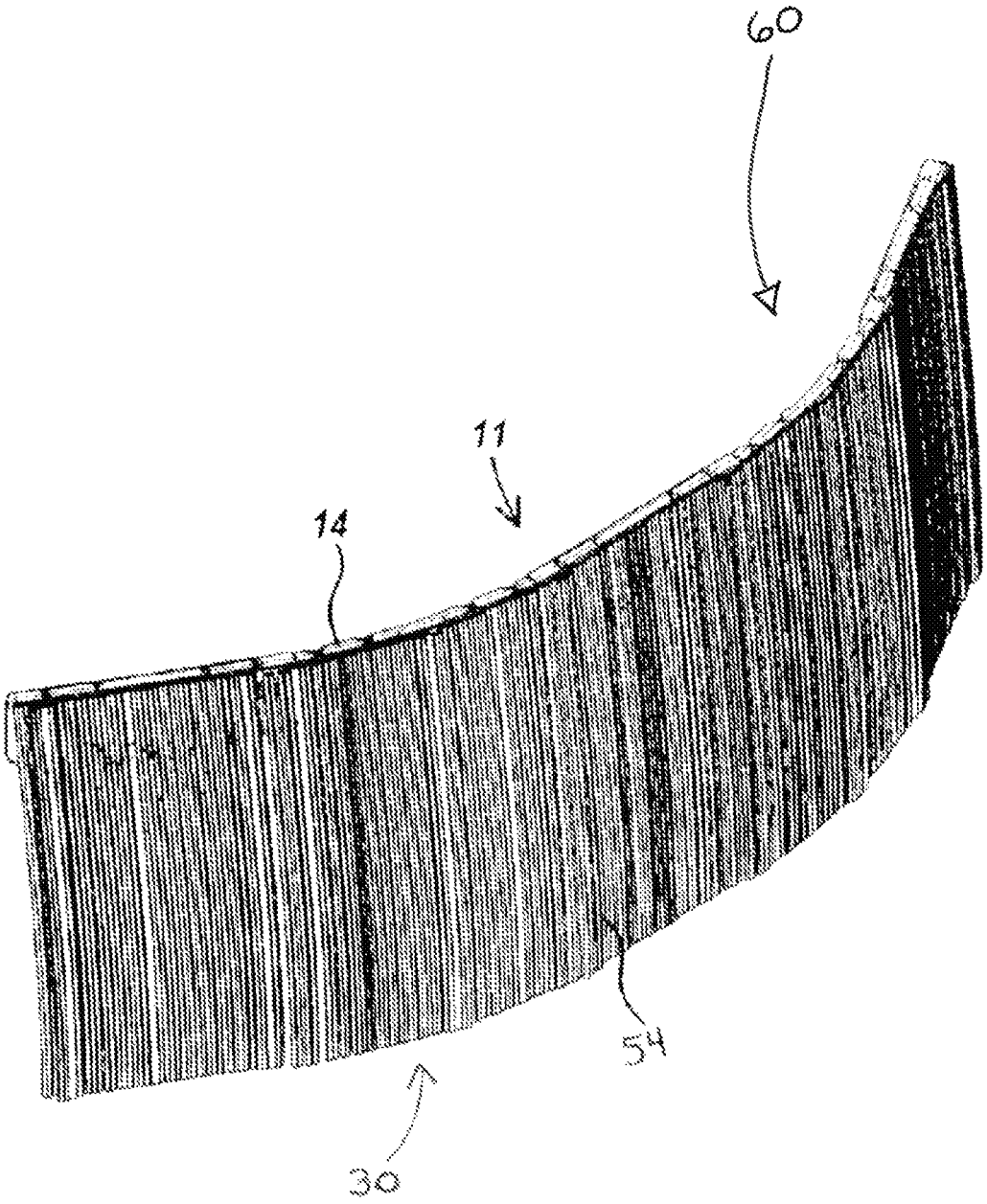
FIG. 7 is a back view of the hair extension assembly.

As shown in FIGS. 6 and 7, the hair extension 30 is secured to the hair extension attachment apparatus 11, thus defining a hair extension assembly 60, and the hair strands 54 of the hair extension 30 cover the entirety of the hair extension attachment apparatus 11. When the hair extension 30 has been applied to the hair extension attachment apparatus 11, the hair extension attachment apparatus 11 cannot be seen externally and the hair strands 54 appear to be regular strands of hair of the user.

In use, the user manually grasps the hair extension attachment apparatus 11 and positions the elongated strip 14 such that the front surface 16 of the elongated strip 14 is facing outward and away from the user's head and the back surface 17 of the elongated strip 14 is facing inward and toward the user's head. The user places the plurality of tines 15 of the clamps 13 into the user's hair and pushes the tines 15 toward the head of the user such that the user's hair is interlocked with the plurality of tines 15. The user then closes the closure member 18 of the clamp 13 by pushing the plurality of teeth 20 of the closure member 18 between the plurality of tines 15. This secures the hair extension attachment apparatus 11 onto the user's hair so the hair extension attachment apparatus 11 does not become dislodged from the user's hair and will not fall therefrom.

Furthermore, to the naked eye, the hair extension attachment apparatus 11 will not be viewed once applied to the user's hair and the hair extension 30 is attached thereto, thus appearing to be the user's genuine hair.

It is therefore submitted that the instant invention has been shown and described in what is considered to be the most practical and preferred embodiments. It is recognized, however, that departures may be made within the scope of the invention and that obvious modifications will occur to a person of ordinary skill in the art. With respect to the above description then, it is to be realized that the optimum dimensional relationships for the parts of the invention, including variations in size, materials, shape, form, function and manner of operation, assembly and use, are deemed readily apparent and obvious to one skilled in the art. Therefore, all equivalent relationships to those illustrated in the drawing and described in the specification are intended to be encompassed by the present invention.

Having thus described the invention, what is claimed is:

1. A hair extension comprising:

(a) a band having a front surface, a back surface, and opposing ends;

(b) a plurality of faux hair strands attached to the band and extending downwardly therefrom;

(c) a retaining member having opposing ends, the retaining member being secured to the band, the retaining member cooperating with the band to define at least one pocket for receiving an associated hook thereon each of the at least one pockets provided between the band and the retaining member;

(d) a hair extension attachment apparatus;

(e) at least one non-hair penetrating L-shaped hook secured to the hair extension apparatus, the hook defining a channel, and wherein the pocket is insertable into the channel to attach the hair extension attachment apparatus to the band.

2. The hair extension of claim 1, wherein the opposing ends of the retaining member are attached to opposing ends of the band over the front surface of the band.

3. The hair extension of claim 1, wherein the retaining member is secured to the band at at least one interval, thereby defining the at least one pocket between the band and the retaining member.

4. The hair extension of claim 1, wherein the retaining member is secured to the band at a plurality of intervals, thereby defining a plurality of pockets, each of the plurality of pockets receiving an associated hook on the hair extension attachment apparatus.

5. A hair extension assembly, comprising:

(a) a hair extension attachment apparatus comprising:

(i) an elongated strip having a front surface, a back surface, and opposing ends;

(ii) at least one clamp disposed on the front surface of the elongated strip for removably securing the elongated strip to the hair of the user; and (iii) at least one non-hair penetrating L-shaped hook disposed on the front surface of the elongated strip; and (b) a hair extension comprising:

(i) a band having a front surface, a back surface, and opposing ends the hook defining a channel;

(ii) a plurality of hair strands attached to the band and extending downwardly therefrom; and (iii) a retaining member having opposing ends, the retaining member secured to the band, the retaining member defining at least one pocket for receiving the at least one hook in the channel on the hair extension attachment apparatus, each of the at least one pocket provided between the band and the retaining member.

6. The hair extension of claim 5, wherein the opposing ends of the retaining member are attached to opposing ends of the band over the front surface of the band.

7. The hair extension assembly of claim 5, wherein the elongated strip comprises a flexible material.

8. The hair extension assembly of claim 5, wherein the hair extension attachment apparatus comprises a plurality of clamps disposed on the elongated strip at fixed intervals.

9. The hair extension assembly of claim 8, wherein each of the plurality of clamps comprises a plurality of parallel tines disposed on the elongated strip and a closure member pivotally affixed thereto, wherein the closure member is movable between an open and closed position configuration.

10. The hair extension assembly of claim 9, wherein the plurality of parallel tines is spaced at a fixed interval.

11. The hair extension assembly of claim 9, wherein the closure member comprises a plurality of teeth thereon to removably engage with the plurality of tines when the closure member is in the closed configuration so as to secure hair therebetween.

12. The hair extension assembly of claim 5, wherein the hair extension attachment apparatus comprises a plurality of hooks disposed on the elongated strip at fixed intervals.

13. The hair extension assembly of claim 12, wherein the retaining member is secured to the band at a plurality of intervals, thereby defining a plurality of pockets, each of the plurality of pockets receiving an associated hook on the hair extension attachment apparatus.

* * * * *